United States Patent [19]

Costello et al.

[11] 4,154,197

[45] May 15, 1979

[54] PACKAGED FLUIDIZED BED STEAM GENERATOR

[75] Inventors: Raymond M. Costello, Cedar Knolls, N.J.; Wayne E. Kramer, Sacramento, Calif.

[73] Assignee: Foster Wheeler Energy Corporation, Livingston, N.J.

[21] Appl. No.: 834,854

[22] Filed: Sep. 19, 1977

[51] Int. Cl.[2] ..... F22B 1/02; F23D 19/02

[52] U.S. Cl. ..... 122/4 D; 110/263

[58] Field of Search ..... 122/4 D; 110/245, 263; 165/104 F

[56] References Cited

U.S. PATENT DOCUMENTS

| | | | |
|---|---|---|---|
| 2,729,428 | 1/1956 | Milmore | 122/4 |
| 3,648,666 | 3/1972 | Foldes et al. | 122/4 |
| 3,659,559 | 5/1972 | Foldes et al. | 122/4 |
| 3,893,426 | 7/1975 | Bryers | 110/245 |

FOREIGN PATENT DOCUMENTS

| | | | |
|---|---|---|---|
| 776791 | 6/1957 | United Kingdom | 122/4 |

*Primary Examiner*—Kenneth W. Sprague

*Attorney, Agent, or Firm*—Marvin A. Naigur; John E. Wilson; John J. Herguth, Jr.

[57] ABSTRACT

A fluid heating unit is provided which includes upper and lower drums, a plurality of riser tubes connected between the drum and defining an enclosure, and means defining a cell within the enclosure for maintaining a fluidized bed of particulate material. The heating unit is of the natural circulation type thereby eliminating the need for forced recirculation pumps.

10 Claims, 3 Drawing Figures

FIG. 1
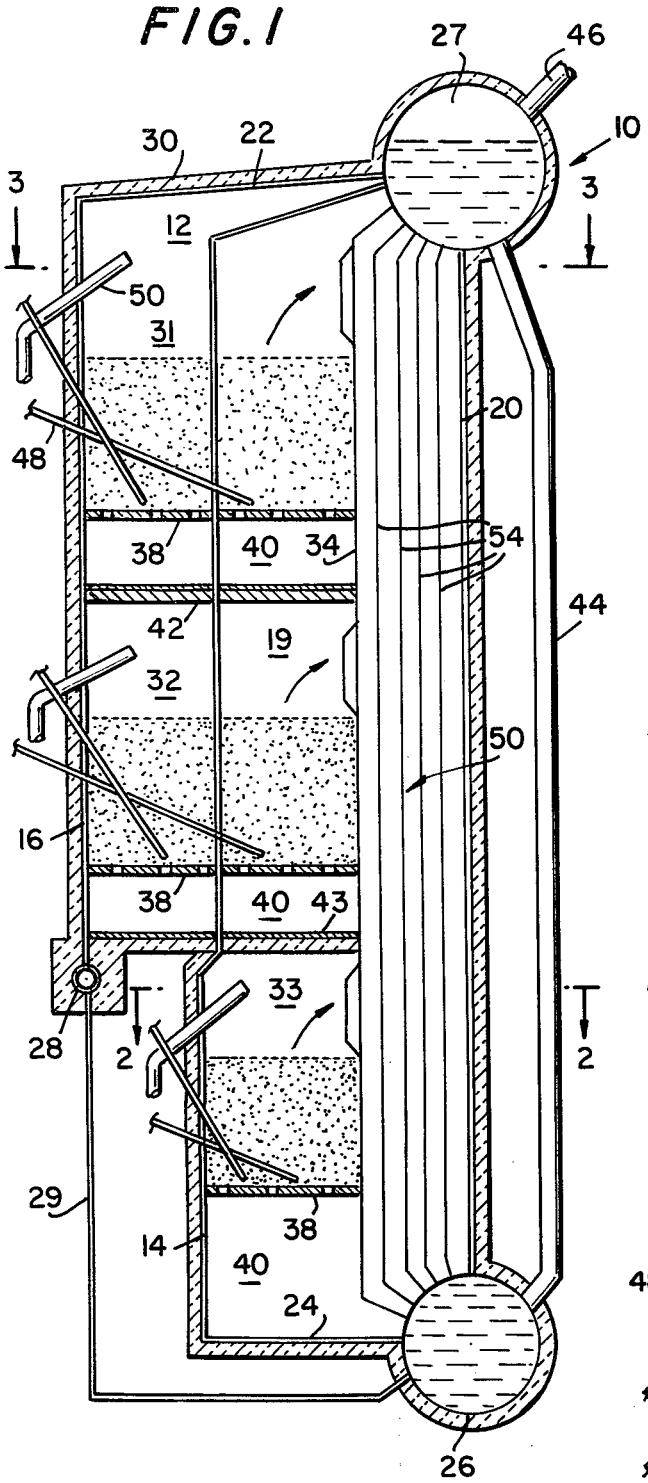
FIG. 2
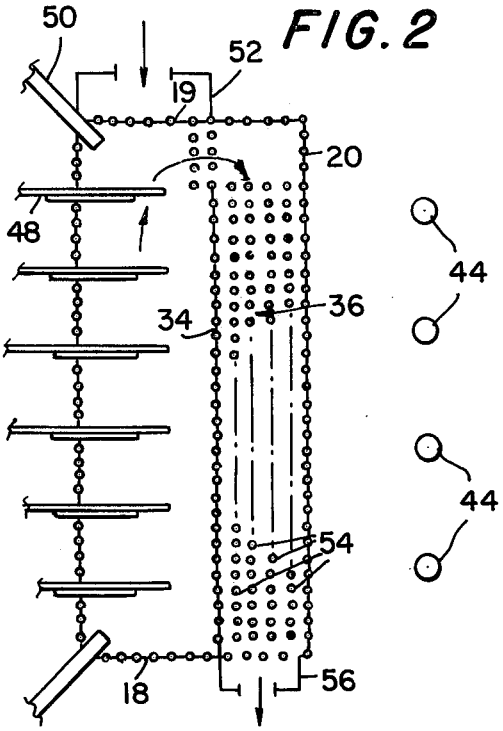
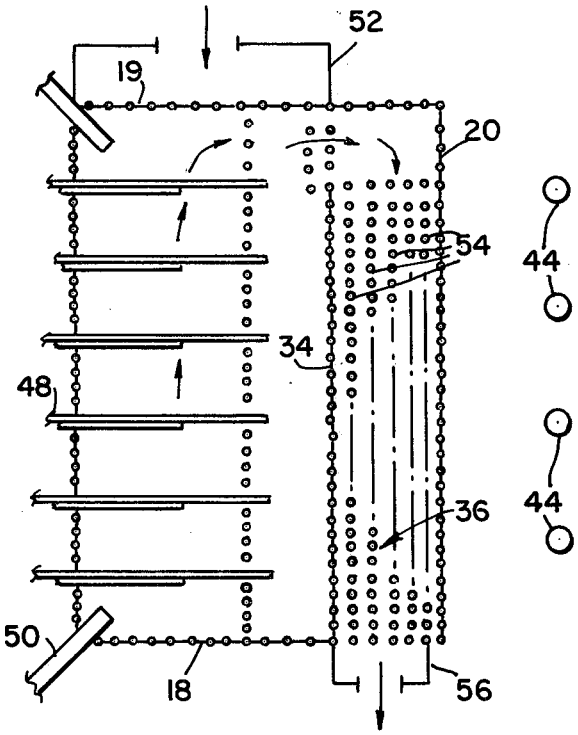
FIG. 3

PACKAGED FLUIDIZED BED STEAM GENERATOR

BACKGROUND OF THE INVENTION

This invention relates to a fluidized bed steam generator and more particularly, to such a steam generator of the natural circulation type utilizing only vertically arranged heating surfaces to cool the fluidized beds.

Several types of fluidized bed steam generators have been proposed in the past. However, these steam generators generally include one or more tube bundles of horizontally disposed tubes located above or immersed within the fluidized bed. In such designs, circulation pumps are required to maintain minimum fluid velocities within the horizontal heating surface. Furthermore, the heretofore suggested designs generally do not lend themselves to shop assembly of the steam generator.

SUMMARY OF THE INVENTION

In accordance with an illustrative embodiment demonstrating features and advantages of the present invention a fluid heating unit is provided which includes an upper steam and water drum, a lower water drum, a plurality of riser tubes connected between the upper and lower drums forming front, side and rear walls, the walls defining an upright enclosure. Means are provided for defining a cell within the enclosure for maintaining a fluidized bed of particulate fuel and sorbent material. Means are also provided for introducing particular fuel material to the cell. Air is passed into the cell to maintain the particulate fuel and sorbent material in a fluidized state. The particulate fuel material is combusted within the cell, and combustion gases are removed from the heating unit. $SO_2$ generated by the combustion of sulfur in the fuel is absorbed by the sorbent material in the bed.

BRIEF DESCRIPTION OF THE DRAWINGS

FIG. 1 is a cross-sectional view of the steam generator.

FIG. 2 is a view taken along lines 2—2 of FIG. 1.

FIG. 3 is a view taken along lines 3—3 of FIG. 1.

DESCRIPTION OF THE PREFERRED EMBODIMENT

Referring to FIG. 1, there is shown the heating unit 10 of the present invention. The unit includes an upright enclosure 12 defined by front wall sections 14, 16, a pair of side walls 18, 19 rear wall 20, roof 22 and floor 24. Each wall, the roof and floor is formed of tubes through which a vaporizable fluid, such as water, can be passed. Adjacent tubes which define enclosure 12 are joined to each other by metal fins, thereby making the enclosure substantially gas-tight. The finned tube arrangement of the enclosure walls is shown in FIGS. 2 and 3. Roof 22 is formed by bending the upper ends of tubes of front wall section 16 out of the plane of the front wall section 16 rearward toward rear wall 20. Similarly, the floor 24 is formed by bending the lower ends of tubes of front wall section 14 out of the plane of the wall section 14 rearward toward rear wall 20. The floor tubes are connected to a lower water drum 26, and in a similar manner the roof tubes are connected to an upper steam and water drum 27. The tubes of front wall section 16 are connected at their lower ends to a horizontal header 28, which is connected to lower water drum 26 by feeder pipes 29. The tubes of the side walls 18 and rear wall 20 are connected at their lower ends to drum 26 and at their upper ends to drum 27. It is understood that the side wall tubes could be connected at their upper and lower ends to headers which would communicate with the respective drums, or these tubes could be arranged for connection directly to the respective drums. Insulation 30 of a conventional type encases the enclosure 12.

Within the enclosure 12 is a series of vertically stacked fluidized bed combustion cells 31, 32 and 33. Upper cell 31 and intermediate cell 32 are main cells, and lower cell 33 is a carbon burn-up cell. Disposed within the enclosure 12 and defining the rear walls of each cell 31, 32 and 33, is division wall 34. Wall 34 is formed from a plurality of tubes extending across the width of the enclosure between side walls 18, 19. The tubes of wall 34 are connected at their lower ends to drum 26 and at their upper ends to drum 27. Across substantially the entire expanse of wall 34 adjacent tubes are joined to each other by metal fins. Therefore division wall 34 acts as a baffle between the cells 31, 32, 33 and conventional section 36 which will be described later. However, adjacent one side wall 19, the tubes are not finned in order to provide openings in wall 34 for passage of combustion gases from cells 31, 32, 33 to convection section 36. Alternate tubes in this area of wall 34 are bent out of the plane of wall 34 to provide more space for the passage of combustion gases. The arrangement of wall 34 tubes is better shown in FIGS. 2 and 3.

Each cell also includes an air distribution plate 38, below which an air plenum chamber 40 is disposed. The cells are separated from one another by means of partitions 42, 43. The upper main cell 31 is therefore defined by front wall section 14, side walls 18, 19, division wall 34, roof 22 and partition 42. The intermediate main cell 32 is defined by front wall section 14, side walls 18, 19, division wall 34 and partitions 42, and 43. The lowermost cells, carbon burn-up cell 33, is defined by front wall section 16, side walls 18, 19, division wall 34, floor 24 and partition 43. Adjacent tubes of front wall section 14 defining the front wall of cell 33 are joined to each other by metal fins up to the level of partition 43 which defines a roof for cell 33. These tubes continue upwardly beyond the level of partition 43, extending through the intermediate and upper main cells 31, 32 and being connected at their upper ends to upper steam and water drum 28. However, the length of these tubes extending through the main cells 31, 32 is not finned, as better shown in FIG. 3.

A plurality of downcomers 44 are disposed externally of the enclosure 12, and are connected at their lower ends to lower water drum 26, and at their upper ends to steam and water drum 27. It is to be understood that in a natural circulation fluid heating unit, such as the instant invention, the circulation of vaporizable fluid results from the density difference between saturated liquid in the unheated downcomers and the steam-water mixture in the heated risers. In the instant invention the risers include the tubes of walls 14, 16, 18, 19, 20, 34 and tubes of convection section 36. Steam is removed from the upper steam and water drum through conduit 46, and sent to a point of use.

Each cell 31, 32, 33 is provided with needles 48 for introducing particulate fuel and bed material into a respective cell. It is to be understood that a sorbent, such as limestone, can be used as bed material for the purpose of regulating the products of combustion which are eventually emitted from the unit. The particulate material introduced to the carbon burn-up cell 33 includes very fine particulate material which has previously been carried from main cells 30 by the combustion gases. The carbon burn-up cell 33 allows for increasing the efficiency of the unit by allowing for utilization of the bed fines which are recycled through the unit. Recycling is accomplished in a conventional manner and therefore no detailed description is provided herein.

Each cell 31, 32, 33 is also provided with bed material removal conduits 50 which are disposed in the corners of each cell. The particulate material is introduced and removed from each cell in a conventional manner and therefore no detailed description of the supply and removal systems is provided herein.

Turning to FIG. 2, a plan view of the carbon burn-up cell 33 of the unit is shown. Air inlet duct 52 communicates with the air plenum chamber 40 of cell 33. Air enters the unit through duct 52, flows into chamber 40 and then passes upwardly through distribution plate 38, thereafter fluidizing the particulate material within cell 33.

A convection section 36 is disposed between division wall 34 and rear wall 20 of the enclosure. A bank of convection tubes 54 are disposed within section 36 and connected between lower water drum 26 and upper steam and water drum 27. Openings are formed in wall 18, as by eliminating fins from between adjacent tubes, in order to allow for the combustion gases to be removed from section 36. A gas outlet 56 is provided adjacent wall 18 for removal of the combustion gases from the convection section 36.

Turning to FIG. 3, a plan view of upper main cell 31 is shown. In this figure the extensions of tubes of front wall section 14 are shown within the main cell 31. Air inlet duct 52 communicates with the plenum chamber 38 associated with the main cell 31 for introducing air to the main cell 31. As with carbon burn-up cell 32, air is introduced through duct 52, passes into chamber 40 then passes upwardly through distribution plate 38, thereafter fluidizing the particulate material within main cell 31. The intermediate main cell 32 operates in substantially the same manner as the upper main cell 31, and will, therefore, not be further described.

It is to be understood that the velocity and flow rate of the air passing through the cells is regulated in a conventional manner in order to fluidize the particulate matter in such a manner as to obtain efficient combustion and to avoid excessive loss of particulate matter from the bed.

Each cell 31, 32, 33 is also provided with ignition means, not shown, of a conventional type for initially firing each cell.

In operation particulate material is introduced to each cell 31, 32, 33 through needles 48. Air is introduced to each cell through inlet duct 52, plenum chambers 40, and distribution plates 38 and thereafter fluidizes the particulate material in the cells 31, 32, 33. For start-up of the unit, ignition means such as an oil burner are fired, and combustion of the particulate fuel is initiated. The ignition means is removed from service after start-up, with combustion continuing in each cell after start-up. The combustion gases leave each cell through openings formed in wall 34 and pass over tubes 54 of convection section 36. The gases are then removed through outlet 56. The vaporizable fluid, such as water, contained in lower drum 26 is heated as it passes through the riser tubes of the walls 14, 16, 18, 19, 20 and 34 and the convection tubes 54. Steam formed in the risers passes to upper drum 27, and is thereafter removed through conduit 50 and sent to a point of use. Liquid returns to the lower drum 26 through external downcomers 44.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A fluid heating unit comprising:

(a) an upper steam and water drum, (b) a lower water drum, (c) a plurality of riser tubes connected between said upper and lower drums forming front, side and rear walls, said walls defining an upright enclosure, said enclosure being so dimensionally proportioned and arranged as to allow for upward flow of heating fluid through said riser tubes occurring as a result of a natural circulation effect, whereby any requirement for a forced circulation pump to achieve circulation of fluid through said riser tubes is eliminated, (d) downcomer means connected between said upper and lower drums externally of said enclosure, (e) means defining a cell within said enclosure for maintaining a fluidized bed of particulate fuel material, (f) means for introducing particulate fuel material to said cell, (g) means for passing air into said cell to maintain said particulate fuel material in a fluidized state, (h) means for combusting said particulate fuel material within said cell, and (i) means for removing combustion gases from said unit.

2. The fluid heating unit of claim 1 further comprising means for rigidly uniting said riser tubes to provide a substantially tight enclosure.

3. The fluid heating unit of claim 2 further comprising means for removing particulate fuel material from said cell.

4. The fluid heating unit of claim 2 further comprising means for bottom supporting said unit.

5. A fluid heating unit comprising (a) an upper steam and water drum, (b) a lower water drum, (c) a plurality of riser tubes connected between said upper and lower drums forming front, side and rear walls, said walls defining an upright enclosure, (d) means defining a cell within said enclosure for maintaining a fluidized bed of particulate fuel material, (e) means for introducing particulate fuel material to said cell, (f) means for passing air into said cell to maintain said particulate fuel material in a fluidized state, (g) means for combusting said particulate fuel material within said cell, (h) means for removing combustion gases from said unit, (i) a convection section within said enclosure including a bank of convex tubes connected between said upper and lower drums, said section disposed adjacent said cell and arranged for serial flow of said combustion gases from said cell, (j) a baffle separating said cell from said convection section, and (k) means for passing said combustion gases from said cell to said convection section.

6. The fluid heating unit of claim 5 wherein said means for passing combustion gases from said cell to said convection section comprises openings in said baffle.

7. The fluid heating unit of claim 6 wherein said baffle comprises an upright wall formed of rigidly united tubes for passing a vaporizable fluid therethrough.

8. The fluid heating unit of claim 7 further comprising means defining additional cells within said enclosure for maintaining respective fluidized beds of particulate fuel material.

9. The fluid heating unit of claim 8 wherein said cells are arranged for parallel flow of heating gases therethrough.

10. The fluid heating unit of claim 7 wherein one of said cells comprises a carbon burn-up cell.

* * * * *